US008166862B2

(12) United States Patent
Morin et al.

(10) Patent No.: US 8,166,862 B2
(45) Date of Patent: May 1, 2012

(54) FIRING PIN ASSEMBLY

(75) Inventors: Gary R. Morin, Hardwick, MA (US); L. Glenn Graves, Arlington, MA (US); Hans A. Hug, Weston, MA (US); John Young, Sutton, MA (US); Daniel R. Deguire, Blackstone, MA (US)

(73) Assignee: Foster-Miller, Inc., Waltham, MA (US)

( * ) Notice: Subject to any disclaimer, the term of this patent is extended or adjusted under 35 U.S.C. 154(b) by 536 days.

(21) Appl. No.: 11/787,845

(22) Filed: Apr. 18, 2007

(65) Prior Publication Data

US 2010/0212482 A1 Aug. 26, 2010

(51) Int. Cl.
*F41A 19/59* (2006.01)

(52) U.S. Cl. ..... 89/28.1; 89/27.3; 42/69.01; 901/1

(58) Field of Classification Search ..... 42/69.01, 42/69.02, 70.08; 89/27.3, 27.11, 28.05, 28.1; 901/1

See application file for complete search history.

(56) References Cited

U.S. PATENT DOCUMENTS 3,641,868 A * 2/1972 Reed ..... 89/1.813
3,750,529 A * 8/1973 Reed et al. ..... 89/1.8
4,207,795 A * 6/1980 Reed et al. ..... 89/1.813
4,617,750 A * 10/1986 Garehime, Jr. ..... 42/65
4,621,562 A 11/1986 Carr et al.
4,932,831 A 6/1990 White et al.
5,022,812 A 6/1991 Coughlan et al.
5,327,810 A * 7/1994 Sandusky et al. ..... 89/27.3
5,610,361 A * 3/1997 Vernet et al. ..... 89/27.13
5,672,044 A * 9/1997 Lemelson ..... 414/744.3
5,949,015 A * 9/1999 Smith et al. ..... 89/41.05
6,113,343 A 9/2000 Goldenberg et al.
6,202,728 B1 * 3/2001 Takada et al. ..... 156/584
6,212,990 B1 * 4/2001 Elspass ..... 89/28.1
6,535,793 B2 3/2003 Allard
6,578,464 B2 6/2003 Ebersole, Jr. et al.
6,745,663 B2 6/2004 Ebersole et al.
6,860,206 B1 3/2005 Rudakevych et al.
6,889,594 B2 5/2005 Ebersole, Jr. et al.
7,143,696 B2 12/2006 Rudakevych et al.
7,357,073 B2 * 4/2008 Aoshima ..... 100/48
7,469,623 B1 * 12/2008 Olcott ..... 89/27.3
7,555,977 B2 * 7/2009 Crotty et al. ..... 89/1.35
2004/0216932 A1 11/2004 Giovanetti et al.
2007/0105070 A1 * 5/2007 Trawick ..... 434/11
2007/0193790 A1 * 8/2007 Goldenberg et al. ..... 180/9.1

(Continued)

OTHER PUBLICATIONS

Northrop Grumman Remotec ANDROS F6A Heavy Duty Robot, http://www.es.northropgrumman.com/remotec/f6a.htm (1 pg).

(Continued)

*Primary Examiner* — Benjamin P Lee
(74) *Attorney, Agent, or Firm* — Iandiorio Teska & Coleman, LLP

(57) ABSTRACT

A firing pin assembly with a firing pin having a shaft with a distal bearing thereon. The firing pin has a standby position, a load position, and a fire position. A cam engages the bearing and is configured to drive the shaft between the standby position and the load position. A spring about the shaft is compressed when the shaft is driven into the load position. A driver turns the cam when energized to drive the shaft from the standby position to the load position and then to turn the cam further whereupon the compressed spring urges the firing pin to fire.

19 Claims, 8 Drawing Sheets

U.S. PATENT DOCUMENTS

| | | | | |
|---|---|---|---|---|
| 2007/0204745 | A1* | 9/2007 | Son et al. | 89/27.3 |
| 2007/0209501 | A1* | 9/2007 | Ko | 89/40.01 |
| 2008/0086241 | A1* | 4/2008 | Phillips et al. | 701/2 |
| 2008/0121097 | A1* | 5/2008 | Rudakevych et al. | 89/28.05 |
| 2009/0026239 | A1* | 1/2009 | Chenel | 224/401 |

OTHER PUBLICATIONS

Northrop Grumman Electronic Systems-Accessories for Remotec ANDROS F6A, http://www.es.northropgrumman.com/remotec/details/f6a_accessories.htm (2pgs).

Northrop Grumman Remotec ANDROS F6A Heavy Duty Robot, http://www.es.northropgrumman.com/remotec/details/f6a_specs.htm (2pgs).

Northrop Grumman Remotec ANDROS F6A Heavy Duty Robot, http://www.es.northropgrumman.com/remotec/wolverine.htm (1pg).

Northrop Grumman Electronic Systems-Remotec ANDROS Wolverine Accessories, http://www.es.northropgrumman.com/remotec/details/wolverine_accessories.htm (2pgs).

Northrop Grumman Remotec ANDROS Mark V-Al Hazardous Duty Robot, http://www.es.northropgrumman.com/remotec/markval.htm (2pgs).

Northrop Grumman Electronic Systems-Remotec-Law Enforcement, SWAT Application, http://www.es.northropgrumman.com/remotec/law_enforcement_swat.htm (2pgs).

Battelle, Law Enforcement Robot Technology Assessment, TWSWG Task T-150B2, Apr. 2000 (87pgs).

* cited by examiner

FIRING PIN ASSEMBLY

FIELD OF THE INVENTION

This subject invention relates to weapons and firing pins for weapons and also to remotely fired weapons.

BACKGROUND OF THE INVENTION

In a traditional firearm, the operator takes some action to load the firing pin (e.g., pulling a bolt) and to then release the firing pin to fire the weapon (e.g., pulling a trigger).

When a firearm is to be fired remotely, however, it can be more difficult to load the firing pin and to also ensure there is no inadvertent firing of the weapon due to jostling, impact, and the like.

This is especially true when the firearm is mounted on a remotely controlled mobile robot. In one specific example, a weapon such as a 40 mm grenade launcher is mounted on a robot platform such as Foster-Miller, Inc.'s (Waltham, Mass.) "Talon" robot. The robot can be maneuvered to a position remote from the operator and the grenade launcher fired. For safety reasons, it is important that the grenade launcher does not fire until so intended by the operator.

SUMMARY OF THE INVENTION

It is therefore an object of this invention to provide a new firing pin assembly.

It is a further object of this invention to provide such a firing pin assembly which is safe.

It is a further object of this invention to provide such a firing pin assembly which can be used with remotely controlled mobile robots and in other systems.

It is a further object of this invention to provide such a firing pin assembly which cannot fire unless the operator of the robot so intends.

The subject invention results from the realization that a safer firing pin assembly includes a shaft driven by a cam between a standby or safe position and a load position and then again to the standby position after firing wherein the firing pin is fixed in place at a distance from the primer of the munition for safety. The subject invention, however, in other embodiments, need not achieve all these objectives and the claims hereof should not be limited to structures or methods capable of achieving these objectives.

The subject invention features a firing pin assembly. A firing pin includes a shaft with a distal bearing thereon. The firing pin has a standby position, a load position, and a fire position. A cam engages the bearing and is configured to drive the shaft between the standby position and the load position. A spring is disposed about the shaft and is compressed when the shaft is driven into the load position. A driver such as a motor turns the cam when energized to drive the shaft from the standby position to the load position and then to turn the cam further whereupon the compressed spring urges the firing pin to fire.

In one example, the drive is configured to turn the cam to the standby position after the pin is fired. There may be a sensor for detecting the position of the cam. In one example, the cam includes a flag which is sensed by the sensor.

The shaft preferably includes a flange thereon for compressing the spring. A fixed bushing abuts an opposite end of the spring and the shaft is slidable through the bushing.

In one embodiment, the shaft includes two sections. The typical firing pin assembly further includes a face with an orifice through which the firing pin fires. The face abuts a munition and the pin in the standby position is fixed by the cam to be spaced from the munition. Preferably, the bearing is rotatable on the shaft.

A robot in accordance with this invention features a robot platform, at least one weapon mounted to the robot platform, and a firing pin assembly for the weapon. The preferred firing pin assembly includes a firing pin including a shaft with a distal bearing thereon. The firing pin has a standby position, a load position, and a fire position. A cam engages the bearing and is configured to drive the shaft between the standby position and the load position. A spring about the shaft is compressed when the shaft is driven into the load position. A driver turns the cam when energized to drive the shaft from the standby position to the load position and then to turn the cam further whereupon the compressed spring urges the firing pin to fire.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
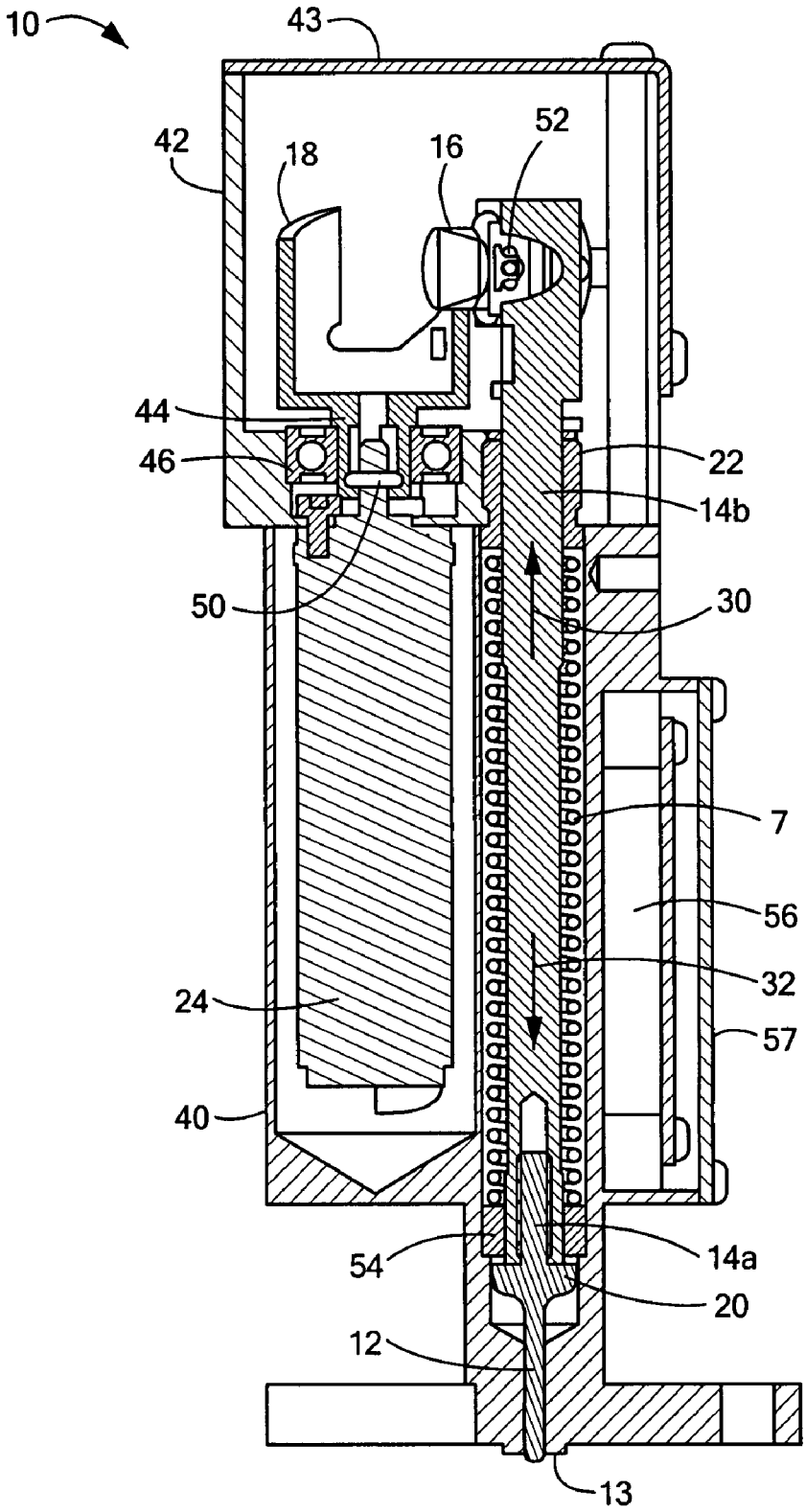
FIG. 1 is a schematic cross-sectional view of an example of a firing pin assembly in accordance with the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

In one particular example, firing pin assembly 10, FIG. 1 includes firing pin 12 slidable through an orifice in face 13. Shaft sections 14*a* and 14*b* extend from firing pin 12. Bearing 16 is fixed to the distal end of shaft section 14*b*. Cam 18 engages bearing 16 and is configured to drive shaft 14 between a standby position (shown in FIG. 1) and a load position. Spring 7 is disposed about shaft 14 and is compressed between flange 20 fixed to shaft 14 and bushing 22 which is fixed in place and does not move with shaft 14. Shaft 14 thus slides within bushing 22. To drive shaft 14 into a load position, a driver such as motor 24, when energized, turns cam 18. The turning of cam 18 drives shaft 14 in the direction of arrow 30 to the load position in which spring 7 is compressed. Further turning of cam 18 allows spring 7 to urge shaft 14 in the direction of arrow 32 to fire firing pin 12.

Thereafter, motor 24 turns cam 18 further to the standby position shown in FIG. 1. In this position, firing pin 12 is spaced (e.g., by 0.10" or more) from the primer of the munition proximate face 13 and firing pin 12 is fixed in place to avoid inadvertent firing.

Other preferred components associated with assembly 10 include lower housing 40 and upper housing 42 with cover 43. Shaft 44 of cam 18 is supported by bearing 46 and is driven by shaft 48 of motor 24 via retaining pin 50 as shown. Bearing 16 preferably rotates with respect to shaft 14 via roller assembly 52. Retainer 54 is positioned between flange 20 and spring 7. Printed circuit board assembly 56 under cover 57 serves as an interface between the power supply to assembly 10 and motor 24.

Figure 2:
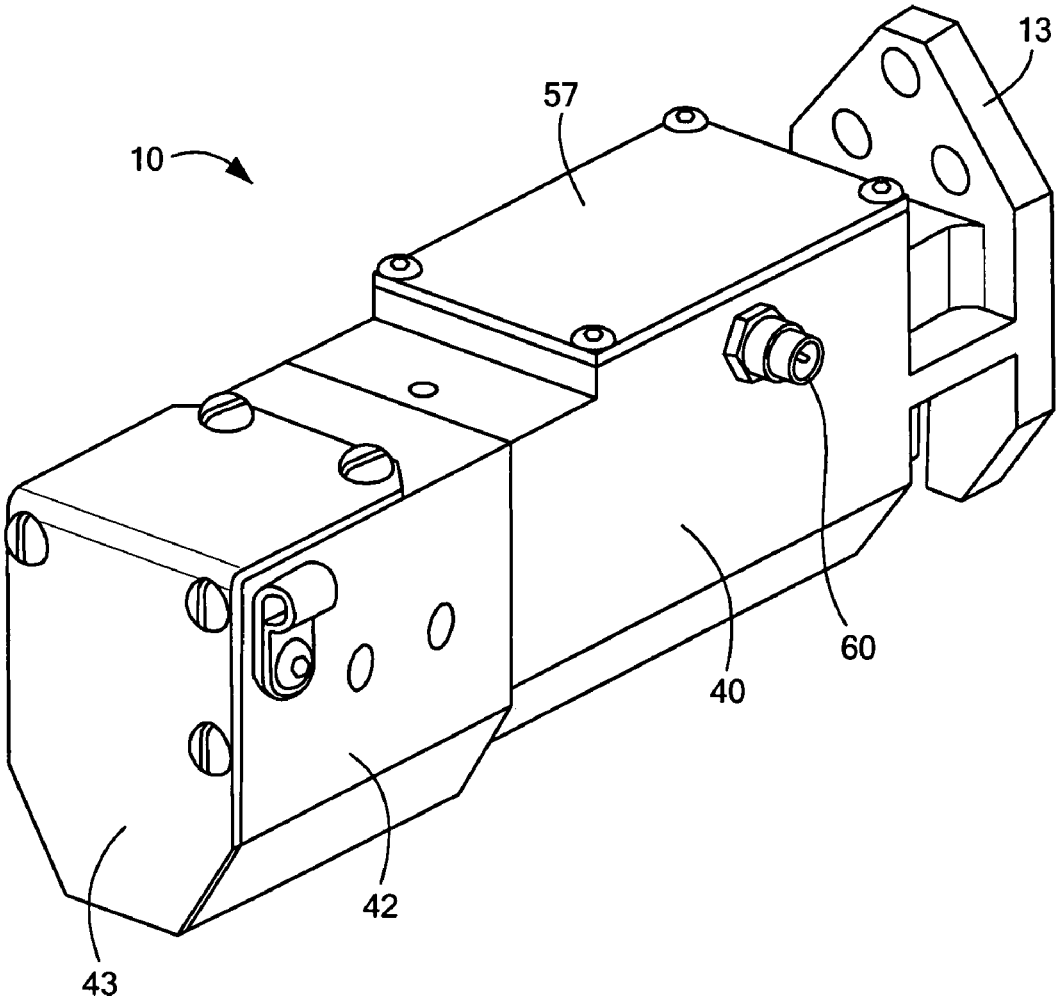
FIG. 2 is a schematic three-dimensional side view of a firing pin assembly shown in FIG. 1.
Figure 3:
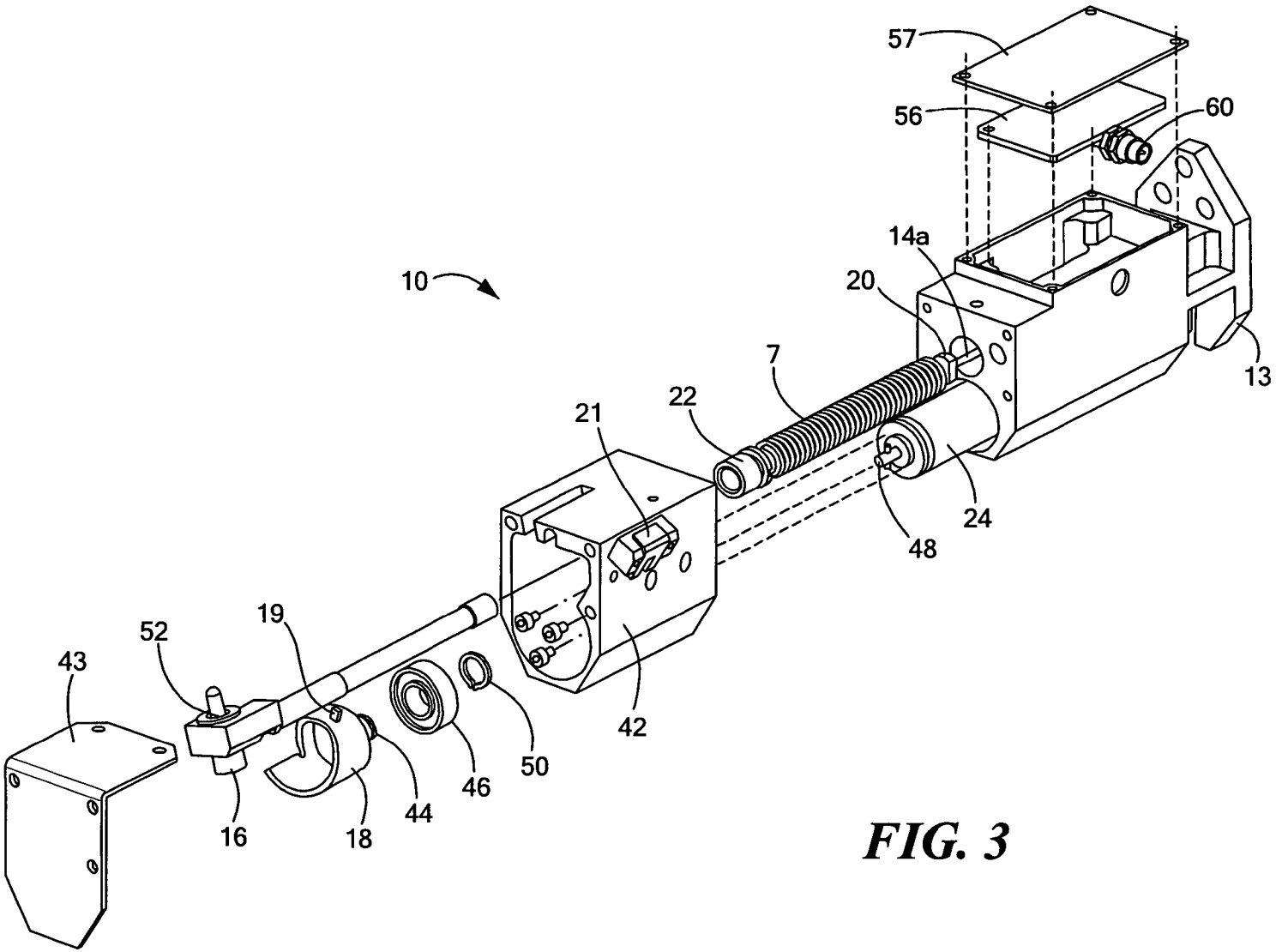
FIG. 3 is an exploded view of the firing pin assembly shown in FIGS. 1 and 2.

FIG. 2 shows power input port 60 for the motor and for the printed circuit board assembly and the general configuration of housing sections 40 and 42. FIG. 3 is an exploded view showing the primary components associated with firing pin assembly 10. Circuitry on printed circuit board 56 monitors sensor 21 and flag 19 on cam 18, when it passes through sensor 21, enables the circuitry to stop motor 24 after one rotation of cam 18. This stops cam 18 in in the standby position.

Figure 4A:
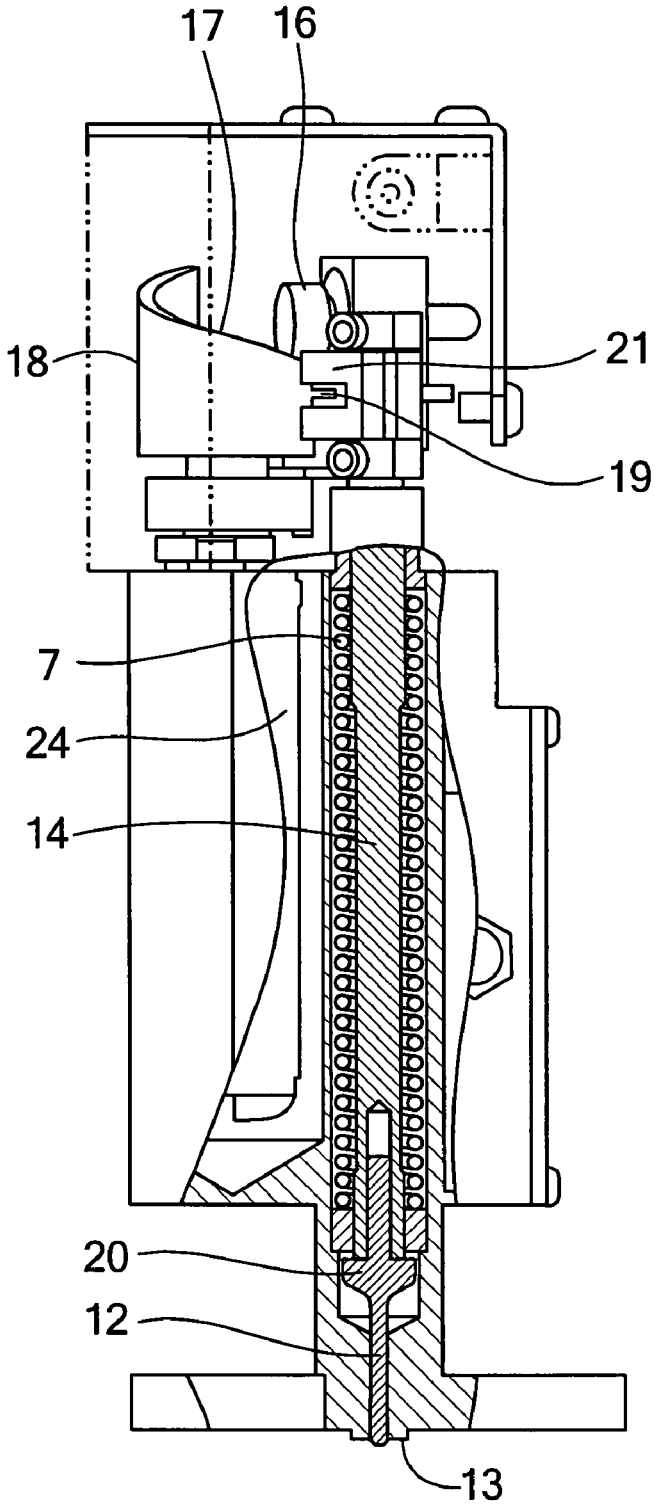
FIG. 4A is a schematic partial cross-sectional view showing the firing pin assembly of FIGS. 1-3 in the standby or safe position.
Figure 4B:
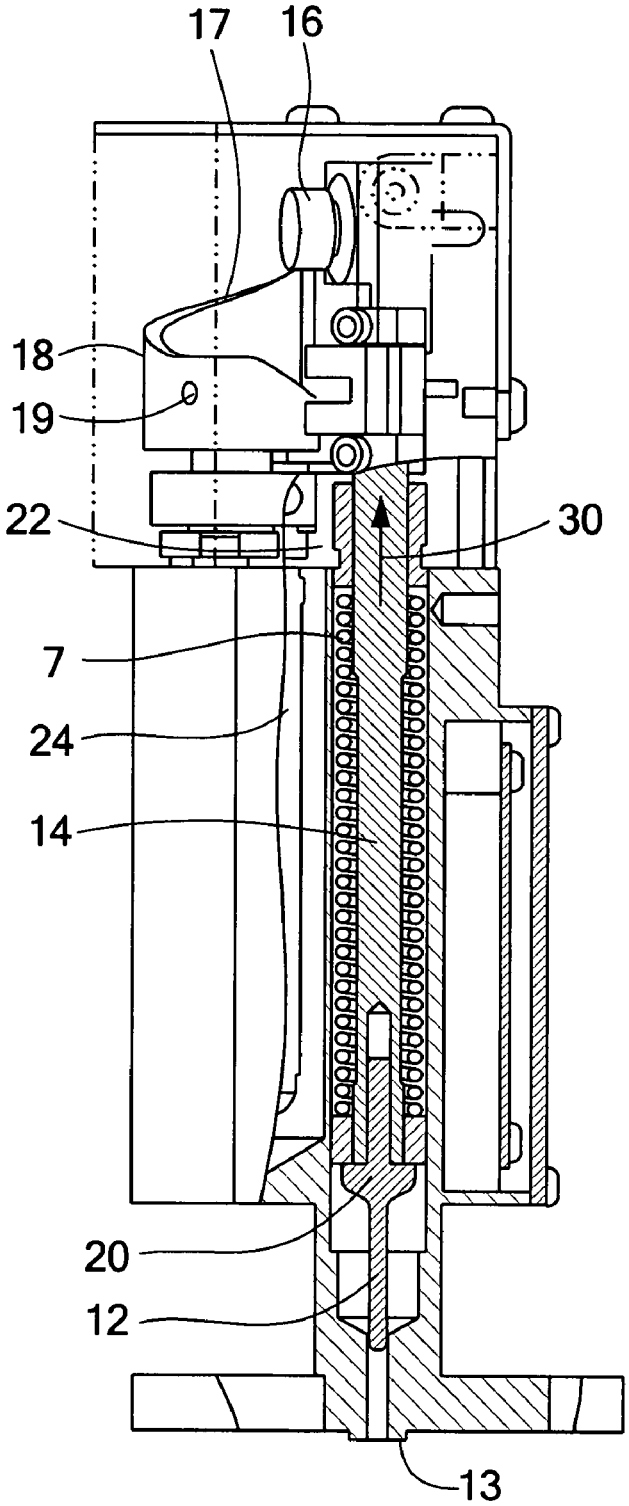
FIG. 4B is a schematic partial cross-sectional view showing the firing pin assembly of FIG. 4A in the load position.
Figure 4C:
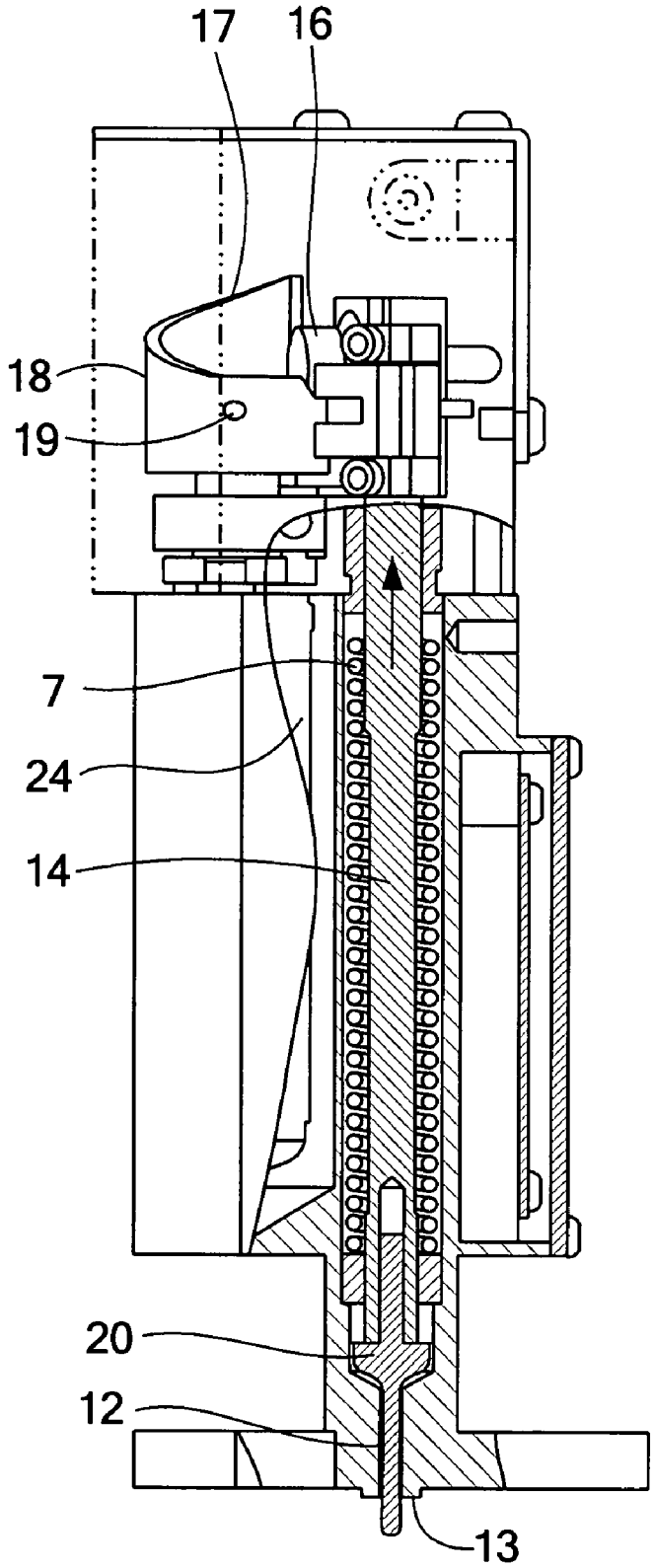
FIG. 4C is a schematic partial cross-sectional view showing the firing pin assembly of FIG. 4B in the fire position.

The standby position of cam 18 and shaft 14 is shown in FIG. 4A. When power is applied at input port 60, FIG. 2, the printed circuit board initializes and within 250 ms motor 24 is energized, cam 18 turns as shown in FIG. 4B whereupon bearing 16 rides up on cam surface 17 to the highest portion thereof. This action compresses spring 7 as shaft 14 is driven in the direction of arrow 30 since flange 20 on shaft 14 also moves in the direction of arrow 30 and spring 7 is constrained between flange 20 and bushing 22. In one example, spring 7 in the standby position shown in FIG. 4A, is 3.3" in length and in the compressed load position shown in FIG. 4B is 2.84" long. In the fire position shown in FIG. 4C, cam 18 has turned further whereupon bearing 16 is no longer constrained by cam 18 surface 17. Spring 7 drives shaft 14 and firing pin 12 to engage the primer of a munition or projectile positioned next to face 13.

Cam 18 then continues to turn until the position shown in FIG. 4A is reached and now bearing 16 engages the lowest point of cam surface 17 in the standby position to prevent inadvertent engagement of firing pin 12 with the primer of a munition. Now, there is no spring force exerted by spring 7. At this point, flag 19 mounted on cam 18 passes through sensor 21 which shuts off motor 24. Sensor 21 may be an optical sensor or a hall effect sensor, or other sensor.

Figure 5:
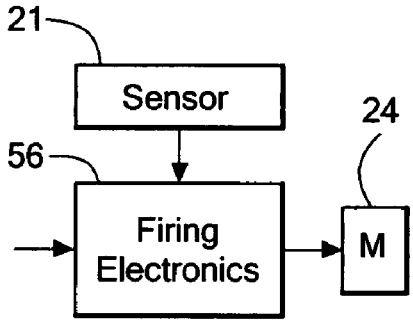
FIG. 5 is a block diagram showing the operation of the electronic firing electronics.

FIG. 5 shows the firing electronics circuit board 56 which receives a signal from a fire control system (not shown). Upon receipt of this signal, circuit board 56 provides power to motor 24 (e.g., a MAXON motor with a stall torque of 28.3 mNm). When sensor 21 indicates the cam has turned one full revolution, sensor 21 provides a signal to firing electronics 56 and motor 24 is de-energized.

Figure 6:
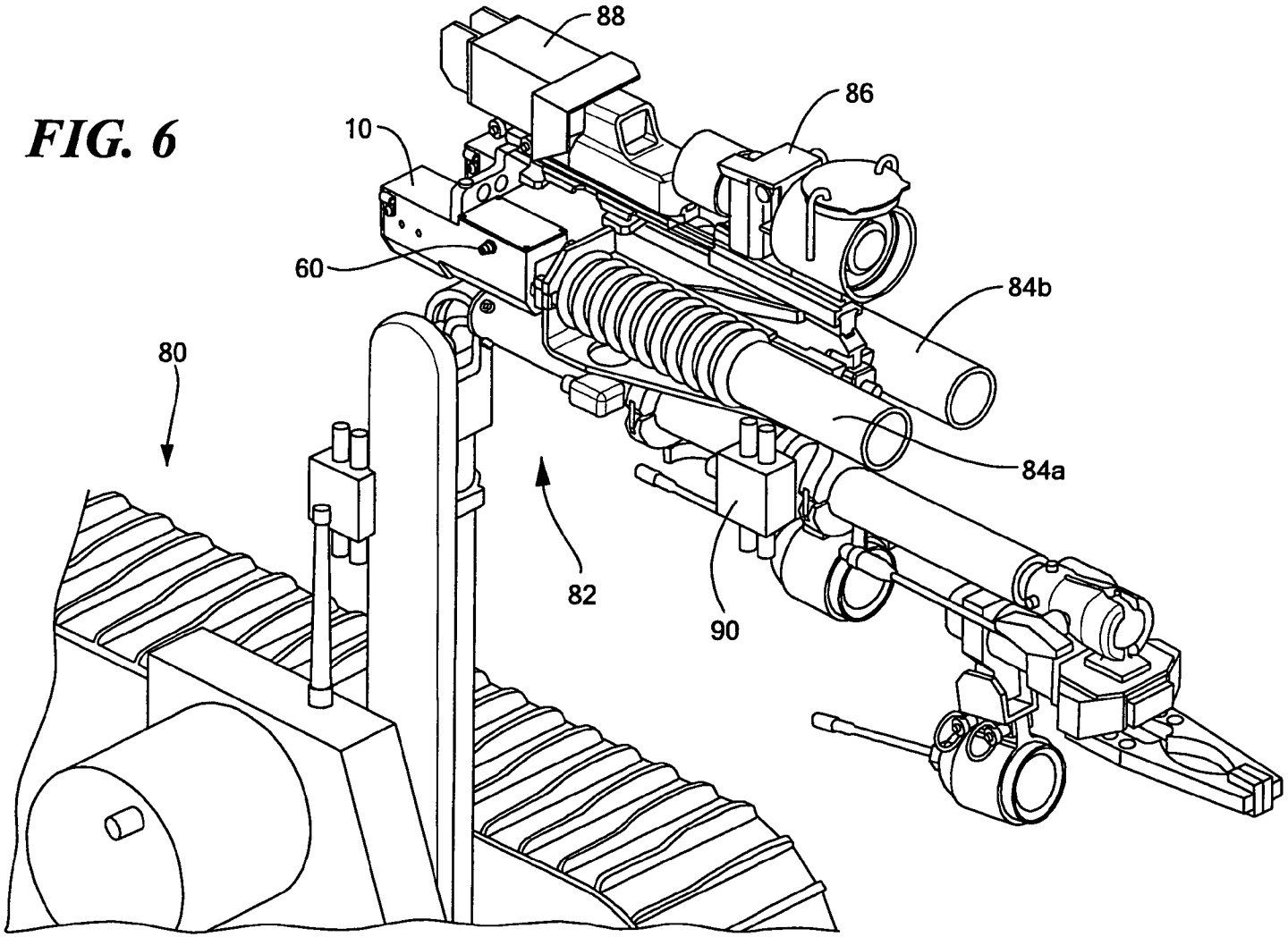
FIG. 6 is a schematic partial three-dimensional view showing an example of a robot with a weapon mounted thereto in an example of an implementation of the firing pin assembly of the subject invention.

In one implementation, firing pin assembly 10 is a component of a remotely controlled mobile robot 80, FIG. 6 (e.g., a "Talon" robot, Foster-Miller, Inc., Waltham, Mass.). Articulatable arm 82 of robot 80 is fitted with dual 40 mm grenade launchers 84*a* and 84*b* each with their own firing pin assembly for striking grenades loaded within the grenade launchers. FIG. 6 also shows night scope 86 and camera 88.

Fire control unit 90 acts as an interface between the fire control system of robot 80 (see co-pending U.S. application Ser. No. 11/543,427 incorporated herein by this reference) and power input port 60 of each firing pin assembly.

Figure 7:
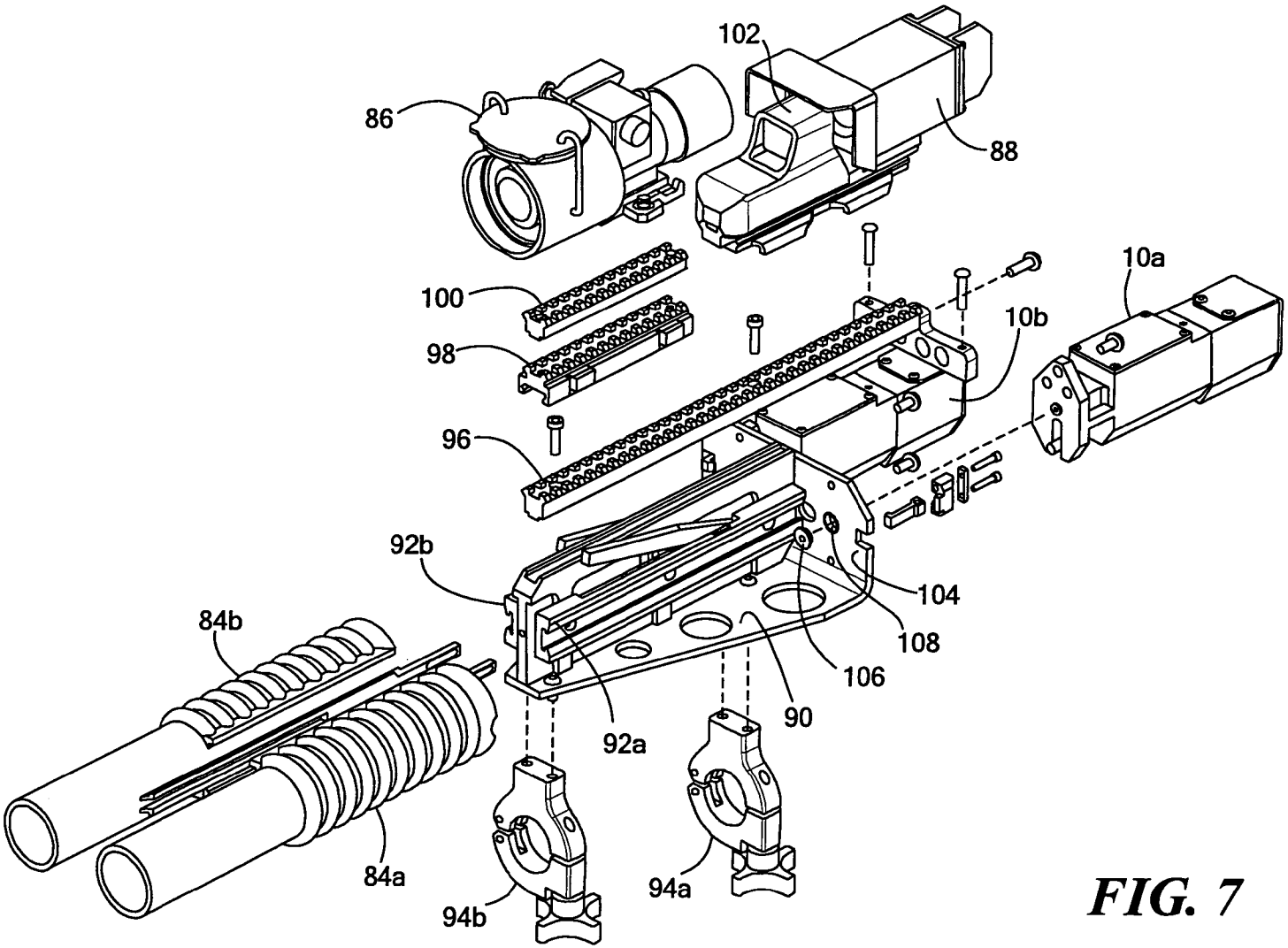
FIG. 7 is a schematic three-dimensional exploded view showing the primary components associated with the weapon shown in FIG. 5.

FIG. 7 shows in more detail the primary components associated with the dual grenade launcher system. Two 40 mm barrels are shown at 84*a* and 84*b*. The barrels are slidable with respect to launcher plate assembly 90 which includes rails 92*a* and 92*b*. Plate assembly 90 is fixed to the robot arm via clamps 94*a* and 94*b*. Rail mount 96 and universal mounts 98 and 100 are for scope 86 and camera 88 fitted with video scope 102. Two firing pin assemblies 10*a* and 10*b* are bolted to rear plate 104 of launcher plate assembly 90. Firing pin insert 106 is fitted within orifice 108 of rear plate 104 and it is this structure which abuts the munition (e.g., a grenade) primer which the firing pin of assembly 10*a* strikes. A similar arrangement is constructed for firing pin assembly 10*b*.

The result is a safer firing pin assembly which cannot fire unless the operator of the robot so intends. The firing pin assembly of the subject invention, however, maybe used in conjunction with weapons other than the grenade launcher subsystem depicted in FIGS. 6-7. Also, the firing pin assembly disclosed herein may find uses apart from a mobile remotely controlled robot mounted with one or more weapons.

Thus, although specific features of the invention are shown in some drawings and not in others, this is for convenience only as each feature may be combined with any or all of the other features in accordance with the invention. For example, the firing pin assembly of the subject invention is useful in connection with weapons other than grenade launchers and in connection with weapons not necessarily mounted on a robot. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A firing pin assembly comprising:

a firing pin including a shaft with a distal bearing thereon, the firing pin having a standby position, a load position, and a fire position;

a helix-shaped cam engaging the bearing and configured to drive the shaft between the standby position and the load position;

a spring about the shaft which is compressed when the shaft is driven into the load position; and a driver for turning the cam when energized to drive the shaft from the standby position to the load position and then to turn the cam further whereupon the compressed spring urges the firing pin to fire.

2. The assembly of claim 1 in which the drive is configured to turn the cam to the standby position after the pin is fired.

3. The assembly of claim 2 further including a sensor for detecting the position of the cam.

4. The assembly of claim 3 in which the cam includes a flag which is sensed by the sensor.

5. The firing pin assembly of claim 1 in which the shaft includes a flange thereon for compressing the spring.

6. The firing pin assembly of claim 5 further including a fixed bushing abutting an opposite end of the spring, the shaft slidable through the bushing.

7. The firing pin assembly of claim 1 in which the shaft includes two sections.

8. The firing pin assembly of claim 1 further including a face with an orifice through which the firing pin fires.

9. The firing pin assembly of claim 8 in which the face abuts a munition and the pin in the standby position is fixed by the cam to be spaced from the munition.

10. The firing pin assembly of claim 1 in which the bearing is rotatable on the shaft.

11. A robot comprising:

a robot platform;

at least one weapon mounted to the robot platform; and a firing pin assembly for the weapon, the firing pin assembly including:

a firing pin including a shaft with a distal bearing thereon, the firing pin having a standby position, a load position, and a fire position, a helix-shaped cam engaging the bearing and configured to drive the shaft between the standby position and the load position, a spring about the shaft which is compressed when the shaft is driven into the load position, and a driver for turning the cam when energized to drive the shaft from the standby position to the load position and then to turn the cam further whereupon the compressed spring urges the firing pin to fire.

12. The robot of claim 11 in which the drive is configured to turn the cam to the standby position after the pin is fired.

13. The robot of claim 11 in which the shaft includes a flange for compressing the spring.

14. The robot of claim 13 further including a fixed bushing abutting an opposite end of the spring, the shaft slidable through the bushing.

15. The robot of claim 11 in which the shaft includes two sections.

16. The robot of claim 11 further including a face with an orifice through which the firing pin fires.

17. The robot of claim 16 in which the face abuts a munition and the pin in the standby position is fixed by the cam to be spaced from the munition.

18. The robot of claim 11 in which the bearing is rotatable on the shaft.

19. The robot of claim 11 in which the weapon is a grenade launcher.

* * * * *